United States Patent [19]

Pratt et al.

[11] Patent Number: 4,902,261

[45] Date of Patent: Feb. 20, 1990

[54] NURSING AID

[76] Inventors: Jolie W. Pratt; Mark S. Pratt, both of 4615 S. Ong, Amarillo, Tex. 79110

[21] Appl. No.: 310,892

[22] Filed: Feb. 16, 1989

[51] Int. Cl.[4] ..... A63H 33/00; A63H 3/00; B65H 75/48; B65D 23/12

[52] U.S. Cl. ..... 446/227; 446/73; 248/102; 242/107; 215/11.1; 215/100 R

[58] Field of Search ..... 446/227, 228, 229, 288, 446/289, 73, 72, 71, 74; 215/11.1, 100 R, 11.6; 248/102, 104, 105, 106; 242/107, 107.6; 273/DIG. 21, 413, 414

[56] References Cited

U.S. PATENT DOCUMENTS

| | | | |
|---|---|---|---|
| 1,589,138 | 6/1926 | Fisk | 215/11.6 |
| 2,450,927 | 10/1948 | Allen | 248/105 |
| 2,696,695 | 12/1954 | Decker | 242/107.6 X |
| 2,744,646 | 5/1956 | Blackstone | 215/11.1 |
| 2,955,382 | 10/1960 | Boles | 446/227 |
| 2,958,156 | 11/1960 | Schmahl et al. | 242/107 X |
| 3,036,791 | 5/1962 | Siggelkow | 242/107 |
| 3,081,895 | 3/1963 | Siegel | 215/11.6 |
| 3,317,936 | 5/1967 | Johnson et al. | 242/107 X |
| 4,340,192 | 7/1982 | Burris, III | 242/107.6 |
| 4,363,171 | 12/1982 | Scandella | 242/107 X |
| 4,564,957 | 1/1986 | Scharf | 248/102 X |

FOREIGN PATENT DOCUMENTS

| | | | |
|---|---|---|---|
| 766082 | 1/1957 | United Kingdom | 215/11.6 |
| 1119916 | 7/1968 | United Kingdom | 248/105 |
| 2029713 | 3/1980 | United Kingdom | 273/414 |
| 2032785 | 5/1980 | United Kingdom | 446/901 |

*Primary Examiner*—Mickey Yu
*Assistant Examiner*—D. Neal Muir
*Attorney, Agent, or Firm*—Leon Gilden

[57] ABSTRACT

A nursing aid is set forth for use in combination with an infant nursing bottle to increase the interest of an infant during a feeding event. The nursing aid includes an elastomeric band formed with a fabric friction enhancing surface with a detachably mounted pliable geometric representation of an animal or the like tethered to the band by an elongate flexible tether line selectively secured to the band by a snap fastener at one end and secured to an interior compartment of the geometric representation by a spring biased axle including a pair of spaced collars to secure and bias the tether line in a normally wound orientation about the axle. A first hook and loop fastener patch is secured to the band cooperative with a second hook and loop fastener patch secured to an underlying surface of the geometrical representation to orient the representation relative to the nursing bottle in a predetermined orientation.

3 Claims, 1 Drawing Sheet

Fig 1
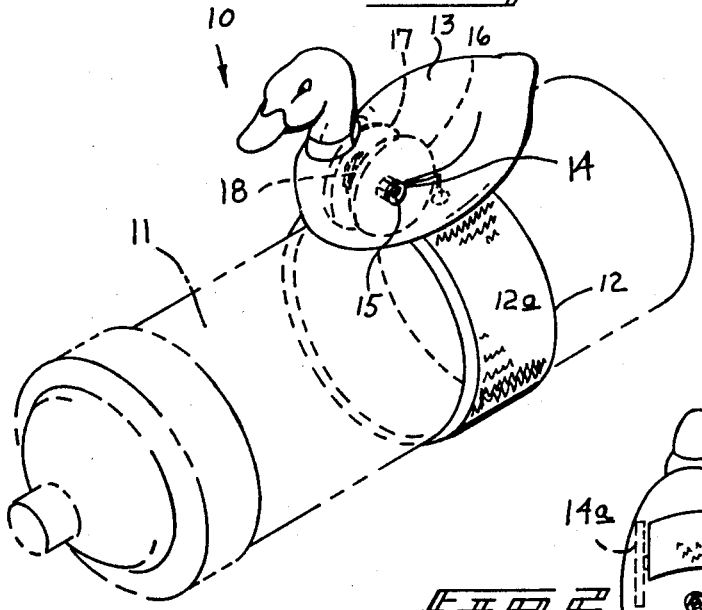
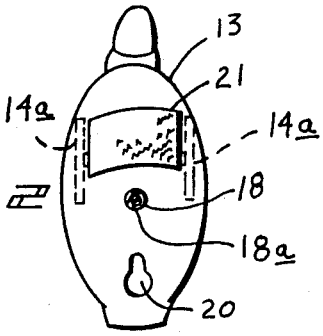
Fig 2
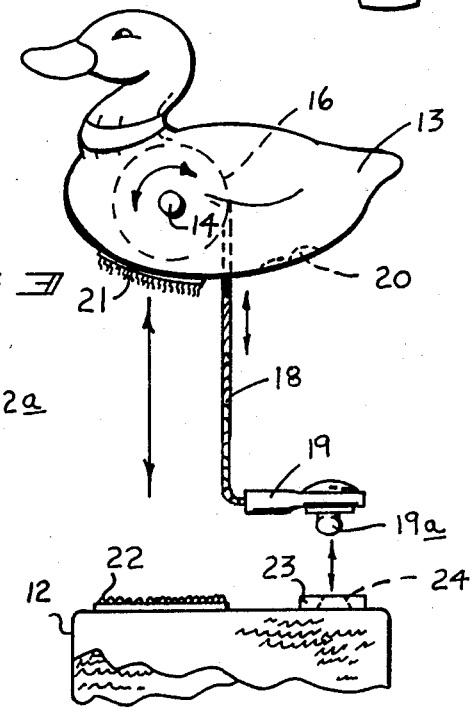
Fig 3
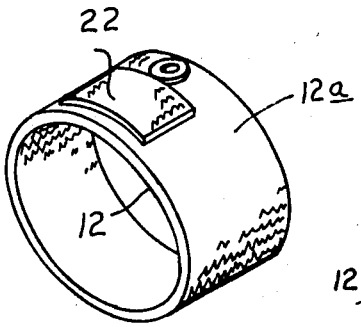
Fig 4

NURSING AID

BACKGROUND OF THE INVENTION

1. Field of the Invention

The field of invention relates to infant feeding devices, and more particularly pertains to a new and improved nursing aid to increase the interest of an infant during a feeding event.

2. Description of the Prior Art

Various nursing aids and interest enhancing devices have been set forth in the prior art for use with a nursing bottle to enhance the interest of an infant during a feeding event. For example, U.S. Pat. No. 2,409,820 to Zimmern sets forth an elongate bottle cover formed with a plurality of animal representations for securement about the bottle to provide a padded cover for the bottle to minimize breakage and enhance grasping of the bottle during the feeding event.

U.S. Pat. No. 2,711,052 to Brayford sets forth a doll utilized as a nursing aid that is securable about the circumference of the bottle as the doll is of a flexible construction to enable intertwining of the doll about the bottle.

U.S. Pat. No. 2,772,801 to Schwortz sets forth a bottle harness for securement of the bottle in a predetermined proximity relative to a tethering position utilizing a cage-like harness securable about the bottle and selectively removable therefrom. The Schwortz patent is cited of interest relative to the circumferential engagement of a harness relative to a nursing bottle.

U.S. Pat. No. 2,955,382 to Boles sets forth a nursing bottle and holder utilizing a circumferential strap with rearwardly oriented loops for securement of the strap to a lowermost end of the bottle with an overlying toy mounted thereto. The Boles patent fails to provide the additional retractable tether line arrangement of the instant invention to enhance interest in use of the bottle during a nursing event.

U.S. design patent No. 145,611 to Butterfield sets forth a nursing bottle holder to completely encompass a nursing bottle and is formed of a configuration to represent an animal-type figure.

As such, it may be appreciated that there is a continuing need for a new and improved nursing aid wherein the same addresses both the problems of ease of use and of providing enhanced interest to a nursing event by an infant, and in this respect, the present invention substantially fulfills this need.

SUMMARY OF THE INVENTION

In view of the foregoing disadvantages inherent in the known types of nursing aids now present in the prior art, the present invention provides a nursing aid wherein the same may be readily secured in a circumferential surrounding relationship to a bottle and is further provided with a tether line resiliently mounted within the removable toy of the bottle to enhance interest of an infant during a nursing or feeding event. As such, the general purpose of the present invention, which will be described subsequently in greater detail, is to provide a new and improved nursing aid which has all the advantages of the prior art nursing aids and none of the disadvantages.

To attain this, the present invention comprises an elastomeric band for frictional engagement of a circumferential exterior portion of a nursing bottle and is provided with a geometric representation of an animal that is selectively securable to the band by a tether line that is resiliently biased to a normally wound position about a spool within the interior of the animal representation. Hook and loop fasteners are formed to the underlying surface of the animal and to the overlying surface of the band to enable orientation of the animal in a predetermined direction.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved nursing aid which has all the advantages of the prior art nursing aids and none of the disadvantages.

It is another object of the present invention to provide a new and improved nursing aid which may be easily and efficiently manufactured and marketed.

It is a further object of the present invention to provide a new and improved nursing aid which is of a durable and reliable construction.

An even further object of the present invention is to provide a new and improved nursing aid which is susceptible of a low cost of manufacture with regard to both materials and labor, and which accordingly is then susceptible of low prices of sale to the consuming public, thereby making such nursing aid economically available to the buying public.

Still yet another object of the present invention is to provide a new and improved nursing aid which provides in the apparatuses and methods of the prior art some of the advantages thereof, while simultaneously overcoming some of the disadvantages normally associated therewith.

Still another object of the present invention is to provide a new and improved nursing aid wherein the same provides for enhanced interest of an infant during a feeding event by enabling the infant to withdraw a geometric representation from about the nursing bottle during feeding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic bottom plan view of the geometrically representative toy of the instant invention.

FIG. 3 is an isometric illustration of the geometrically representative toy and its association with the band of the instant invention.

FIG. 4 is an isometric illustration of the band of the instant invention.

DESCRIPTION OF THE PREFERRED EMBODIMENT

With reference now to the drawings, and in particular to FIGS. 1 to 4 thereof, a new and improved nursing aid embodying the principles and concepts of the present invention and generally designated by the reference numeral 10 will be described.

More specifically, the nursing aid 10 of the instant invention essentially comprises the apparatus in a resilient surrounding engagement of an exterior circumferential surface of a nursing bottle 11. The nursing aid 10 is formed with an elastomeric band 12 including an enhanced friction surface **12*a* formed of a filament or fabric-type covering. The covering provides for enhanced grasping of the nursing bottle 11 when the nursing aid 10 is secured thereto and provides a degree of comfort in the securement of the bottle by an infant. A detachably mounted geometric presentation toy 13** is formed of a pliable type material to minimize injury of the toy during a grasping event and is typically formed of an animal-like configuration, as illustrated, but it is understood the toy may be of a variety of geometric representations pleasing to an infant.

Mounted interiorly of the toy 13 is a transversely oriented axle 14 mounted rotatably within braces **14*a* within the toy to maintain the axle in alignment relative to the toy. The axle is provided with a captured spring therewithin to normally bias the axle in a retracted position in association with the flexible tether line 18 normally wound about the axle. The tether line 18 is positioned between parallel spaced coaxial first and second collars 16 and 17 respectively to direct the tether line in a predetermined orientation relative to a through-extending opening, as illustrated in FIG. 2, formed through the bottom surface of the toy 13. A remote end of the tether line 18 is provided with an integral enlarged positioning head 19 that includes a fastener plug 19*a*. The underlying surface of the toy 13 includes a recess 20 of a generally key-like configuration complementary to the configuration of the enlarged head 19 to receive the head 19 therewithin and thereby in a nested relationship within the recess 20. Also positioned within the underlying surface of the toy 13 and in alignment with the tether line opening 18*a* and the recess 20 is a first hook and loop fastener patch 21 operably and selectively associatable with a second hook and loop fastener patch secured to an outermost surface of the elastomeric band 12. Accordingly, the toy 13, when in a retracted position, may be oriented as desired relative to the nursing bottle 11 and the band 12 by its angular securement of the first hook and loop fastener patch 21 to the second hook and loop fastener patch 22. Positioned adjacent and aligned medially of the second loop fastener patch 22 is a securement boss 23 extending upwardly of the surface 12*a* of the band and provided with a cavity 24 formed with a tapered entrance to securedly capture and receive the fastener plug 19*a* when positioned within the cavity 24 to thereby secure the tether line 18 relative to the band 12 and may be further removed from the boss 23 for compact storage of the nursing aid 10** during periods of non-use.

As such, the use and operation of the instant invention should be apparent from the above description, and accordingly no further discussion relative to the use and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A nursing aid for securement about an infant nursing bottle comprising, in combination, a securement band for securement about an outer surface of the bottle, and a toy member including an extensible and retractable tether line mounted interiorly of the toy at one end of the tether line, and the tether line selectively securable to the band at a further end of the tether line remote from the toy, and wherein the securement band is formed of elastomeric material for resilient grasping of the bottle and includes an exterior friction surface formed of filament material, and wherein the toy member includes a spool including a plurality of spaced collars about a central axle wherein the spool is formed with a captured spring to bias the spool in a first position with a tether line wound about the spool, and wherein the tether line is retractable from interiorly of the toy to a second position wherein the tether line is withdrawn from the spool in an extended orientation relative to the spool, and wherein the tether line is formed with an enlarged positioning head at the further end, and the positioning head is formed with an outwardly extending fastener plug directed outwardly of the positioning head, and wherein the band includes a securement boss for receiving the plug of the positioning head wherein the securement boss is formed with a cavity provided with a tapered entrance to capture the plug when directed within the cavity.

2. A nursing aid as set forth in claim 1 further including a recess of a predetermined configuration complementary to the predetermined configuration defined by the head.

3. A nursing aid as set forth in claim 2 further including a first hook and loop fastener patch secured to the underlying surface of the toy aligned with the recess, and cooperative with a second hook and loop fastener patch secured to an exterior surface of the band aligned with the securement boss.

* * * * *